US005598791A

United States Patent [19]

Taylor

[11] Patent Number: 5,598,791

[45] Date of Patent: Feb. 4, 1997

[54] SHELVING APPARATUS AND METHOD OF ASSEMBLY

[76] Inventor: Alva R. Taylor, 206 SE. 10th St. Apt. 101, Bldg. #3, Dania, Fla. 33004

[21] Appl. No.: 411,326

[22] Filed: Mar. 27, 1995

[51] Int. Cl.[6] ..... A47B 3/00

[52] U.S. Cl. ..... 108/193; 108/190; 108/153

[58] Field of Search ..... 108/42, 180, 192, 108/193, 153, 144, 107, 106, 110, 107, 190; 211/187, 190, 191

[56] References Cited

U.S. PATENT DOCUMENTS

| | | | |
|---|---|---|---|
| 775,497 | 11/1904 | Parsons | 108/106 |
| 1,169,720 | 1/1916 | Harris | 108/106 |
| 1,288,010 | 12/1918 | Isaac | 108/144 |
| 2,935,210 | 5/1960 | Cohen | 108/106 X |
| 2,988,233 | 6/1961 | Pendergrast, Jr. et al. | 108/153 |
| 3,050,194 | 8/1962 | Sinninger | 108/106 |
| 3,862,691 | 1/1975 | Mori et al. | 108/180 X |
| 4,093,167 | 6/1978 | Rooklyn | 108/153 X |
| 5,463,966 | 11/1995 | Nilsson | 108/193 X |

*Primary Examiner*—Jose V. Chen
*Attorney, Agent, or Firm*—Oltman Flynn & Kubler

[57] ABSTRACT

A shelving apparatus includes at least one shelf, several elongate channel leg members, each channel leg member having a substantially U-shaped cross-section, two of each of the leg members forming a leg member pair, several shelving support elements for each shelf, each shelving support element having channel leg member entry portions for mounting within one of the channel leg members, and having shelf support portions extending between the two channel leg members in each leg member pair, where the leg member pairs are positioned substantially vertically upright in a spaced apart straight line series, and where the shelf members are placed on top of the shelf support portions so that the shelf members extend longitudinally through the series of leg member pairs, The apparatus preferably additionally includes end cap anchor members for securing to top and bottom ends of the channel leg member pairs for bolting to an adjacent structure for added apparatus stability,

11 Claims, 4 Drawing Sheets

SHELVING APPARATUS AND METHOD OF ASSEMBLY

BACKGROUND OF THE INVENTION

1. Field of the Invention

The present invention relates generally to the field of shelves and bookcases. More specifically the present invention relates to a shelving apparatus which is assembled from a kit. All preferred embodiments of the apparatus include several elongate channel leg members, each having a substantially square U-shaped cross-section and several shelves. The channel leg members are divided into sets or pairs of two leg members each. Shelving support elements for each shelf to be installed are fit into and are secured within the channel leg members, and extend between the two leg members of each pair. The number of shelves accommodated can vary from one to as many as space and strength of the kit materials permit. The pairs of leg members are set vertically upright, face to face and parallel in a spaced apart straight line series. Shelves are placed on top of a shelving support element of each leg member pair, the shelf width extending between the leg members of each pair, so that each shelf extends longitudinally through the series of leg member pairs. The channel leg members may be bolted to a wall for added stability, or end cap anchor members may be secured to the tops and bottoms of the leg member pairs and bolted to a ceiling, wall or floor, or to all of these. The shelf apparatus preferably extends along a wall from one corner to the opposing corner of a room.

2. Description of the Prior Art

There have long been wall shelves and bookcases for retaining and displaying various items. These prior devices generally have several disadvantages.

A problem with wall shelves is that they cannot reliably carry heavy loads. There is always the danger of the shelf bracket screws pulling out of the wall, given the absence of support from below the shelves. Another problem with wall shelves is that they are labor intensive to move. They must be fully disassembled for removal to another wall.

A problem with bookcases is that they are typically large, heavy, and cumbersome to transport. When a conventional bookcase is provided in kit form, the kit is typically complicated to assemble.

It is thus an object of the present invention to provide a shelving apparatus in kit form which is easy to assemble and requires few or no tools.

It is another object of the present invention to provide such an apparatus for which the kit is compact, of relative light weight and easy to transport.

It is still another object of the present invention to provide such an apparatus which has a minimal number of parts.

It is finally an object of the present invention to provide such an apparatus which is inexpensive to manufacture and can be assembled from common, off-the-shelf hardware elements.

SUMMARY OF THE INVENTION

The present invention accomplishes the above-stated objectives, as well as others, as may be determined by a fair reading and interpretation of the entire specification.

A shelving apparatus is provided, including at least one shelf, several elongate channel leg members, each channel leg member having a substantially U-shaped cross-section, two of each of the leg members forming a leg member pair, several shelving support elements for each shelf, each shelving support element having channel leg member entry portions for mounting within one of the channel leg members, and having shelf support portions extending between the two channel leg members in each leg member pair, where the leg member pairs are positioned substantially vertically upright in a spaced apart straight line series, and where the shelf members are placed on top of the shelf support portions so that the shelf members extend longitudinally through the series of leg member pairs. The apparatus preferably additionally includes end cap anchor members for securing to top and bottom ends of the channel leg member pairs for bolting to an adjacent structure for added apparatus stability.

For one embodiment of the apparatus, the channel leg members each preferably have a substantially square channel cross section with two substantially parallel, opposing side channel walls connected at corresponding side wall ends by a connecting channel wall, and an open channel side, and the shelving support elements include a series of cross-braces, each in the form of a substantially rectangular planar member having two ends and two longitudinal sides, each of the ends being sized for snugly fitting into the open channel side of each the channel leg member of a leg member pair, where the shelf support portions each include one longitudinal side, the cross-braces being separated from each other by a certain distance, and additionally including several elongate support pegs each having a length equivalent to the certain distance, and sized in cross-section for snug insertion into the leg member open channel sides between the cross-braces, to support the cross-braces and shelves. Each leg member pair has top and bottom pair ends, and preferably additionally includes an end cap anchor member for securing to one pair end, the end anchor cap having at least one anchor fastener port for receiving a fastener to secure the apparatus to a separate structure for added stability. The end cap anchor member preferably includes a square channel member having two opposing side cap walls and a connecting cap wall. The connecting cap wall optionally extends longitudinally beyond the side cap walls to form a tab portion, the tab portion having a fastener port for receiving a fastener for securing the apparatus to a separate structure. The tab is optionally bent out of the plane of the connecting cap wall to make greater contact with the separate structure.

For another embodiment of the apparatus, the channel leg members each have a substantially square channel cross-section with two substantially parallel, opposing side channel walls connected at corresponding side channel wall ends by a connecting channel wall, and an open channel side, and where the shelving support elements include a series of cross-braces, each in the form of a substantially rectangular planar member having two end sides and two longitudinal sides, each of the end sides being sized for snugly fitting into the open channel side of each channel leg member of a leg member pair, where the shelf support portions each include one longitudinal side, the cross-braces being separated from each other by a certain distance corresponding to the thickness of the shelf, so that the shelf extends snugly between and carries loading transmitted by the cross-braces.

For still another embodiment of the apparatus, the channel leg members each have a substantially square channel cross-section with two substantially parallel, opposing side channel walls connected at corresponding side channel wall ends by a connecting channel wall, and a fourth side including a longitudinal flange extending from each side channel wall toward the opposing side channel wall, the flanges being sized in width relative to the width of the connecting channel wall to be spaced apart from each other, each connecting channel wall having a channel port, and where the shelving support elements include a series of cross-braces, each in the form of an elongate threaded rod having a guide nut at each rod end for lateral insertion into an end of one of the channel leg members and fitting sufficiently closely between the side channel walls that the nut cannot rotate substantially relative to the leg member, the connecting channel wall including a rod port for receiving the rod through rotation of the rod within the nut so that the rod advances into the port. Each cross-brace preferably additionally includes an inner locking nut for each end of each threaded rod for advancing into snug contact against one of the leg members. Each cross-brace additionally includes an outer locking nut for each end of each the threaded rod for advancing into snug contact against one of the leg members.

A method is also provided of assembling a shelving apparatus of the embodiment set for immediately above, including the steps of fitting the guide nuts onto a first end of each threaded rod cross-brace, so that the cross-brace does not extend substantially from the side of the guide nuts opposite the side of the guide nuts where the cross-brace is inserted, positioning the cross-braces so that a circumferential face of each guide nut is aligned with the open end of each leg member, laterally inserting the guide nuts into the channel leg members until the cross-braces are aligned with one of the cross-brace ports, rotating each cross-brace to advance the adjacent cross-brace end through the given the cross-brace port a certain distance, screwing the guide nuts onto the second ends of the cross-braces, so that the cross-braces do not extend substantially from the side of the guide nuts opposite the side of said guide nuts where the cross-brace is inserted, fitting the second leg member over and around the guide nuts on the second ends until the cross-braces are aligned with the ports, rotating the threaded rod cross-braces in a second rotational direction to advance the cross-braces through the ports in the second leg member, so that a segment of the cross-braces continues to extend through the ports in the first leg member, positioning the leg pairs upright and in a spaced apart linear series, and placing the shelves over corresponding cross-braces in each pair, longitudinally along the series.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
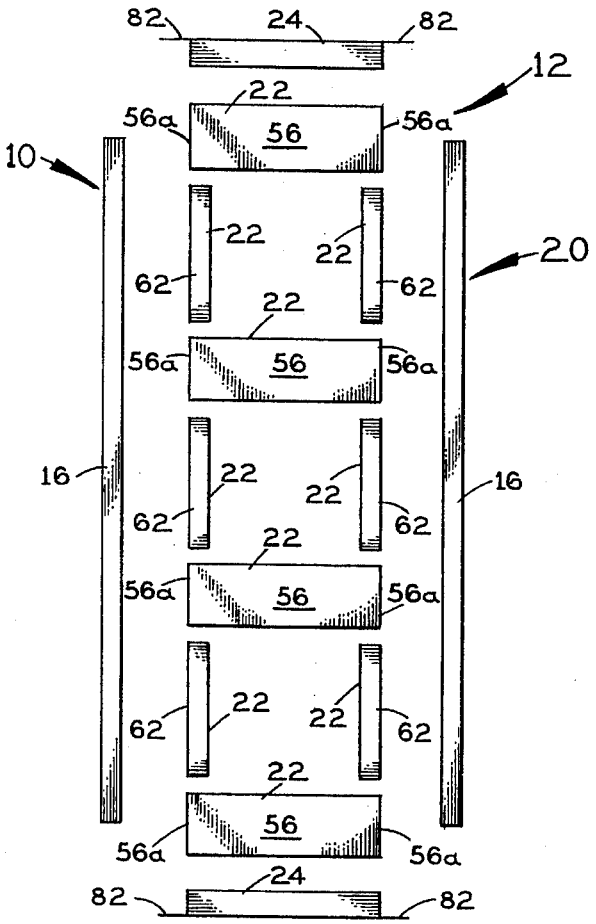
FIG. 1 is an exploded view of the kit elements for the first preferred embodiment of the inventive apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments Generally

Figure 2:
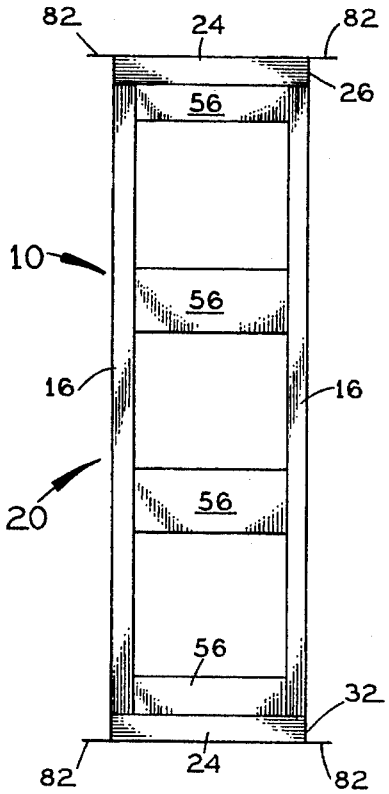
FIG. 2 is a view as in FIG. 1, except that the kit elements are assembled into a leg member pair.
Figure 3:
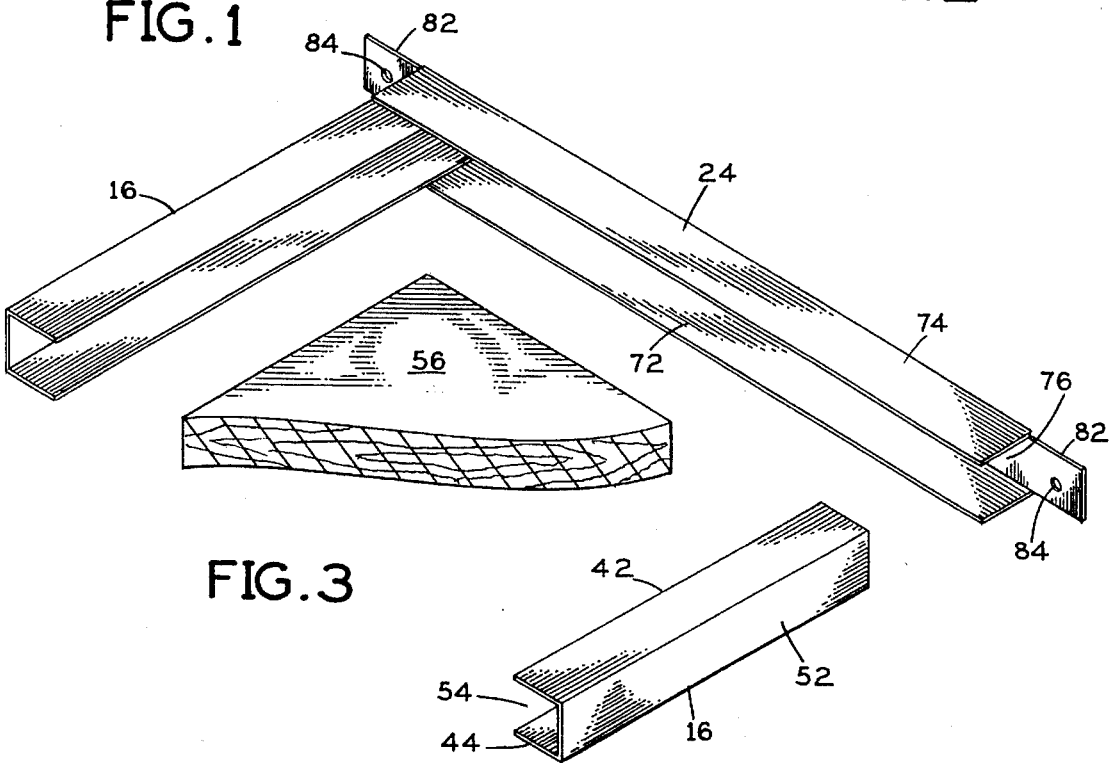
FIG. 3 is a perspective view of an end cap, a corner of a cross-brace and an end of a channel leg member, revealing some structural detail of each.
Figures 4, 5, 6:
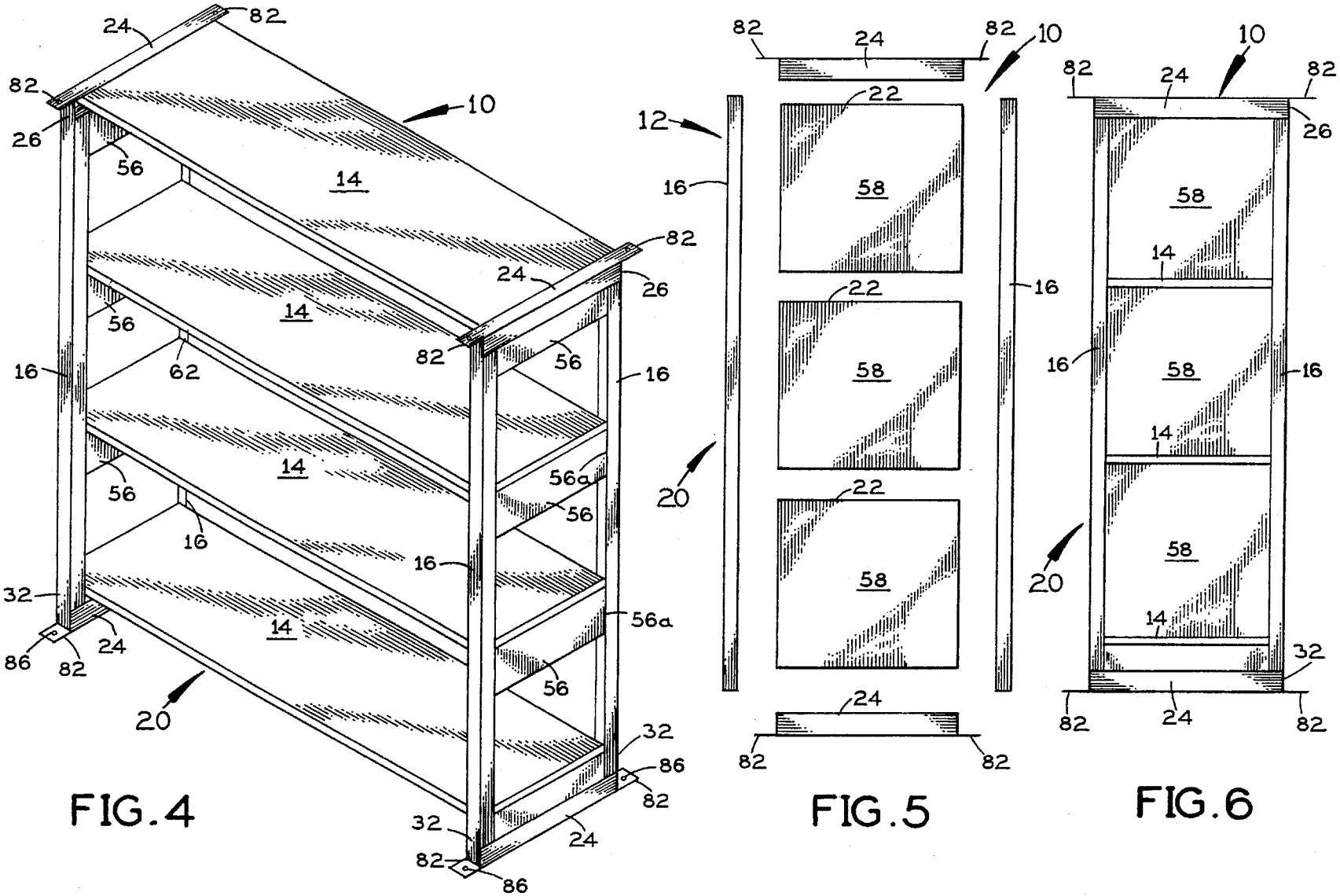
FIG. 4 is a perspective view of the completely assembled first preferred embodiment.
FIG. 5 is an exploded view of the kit elements for the second preferred embodiment of the inventive apparatus.
FIG. 6 is a view as in FIG. 5, except that the kit elements are assembled into a leg member pair.
Figures 7, 8, 9, 10:
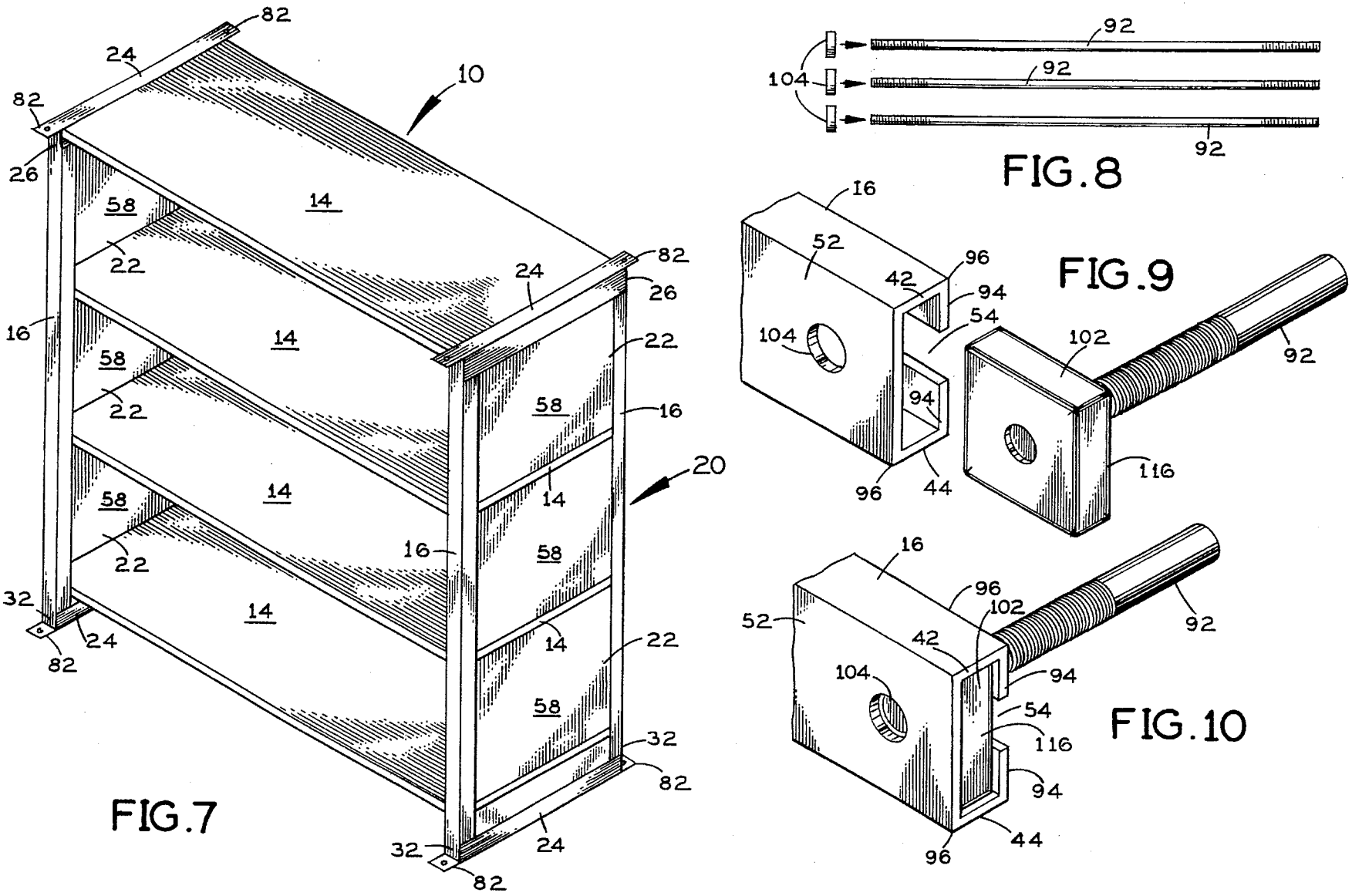
FIG. 7 is a perspective view of the completely assembled second prefigured embodiment.
FIG. 8 is a side view of three threaded rod cross-braces adjacent to three corresponding guide nuts to be fitted onto the cross-brace ends.
FIG. 9 is a perspective view of an end of a threaded rod cross-brace with a guide nut fit flush onto the rod end and positioned for insertion into an end of a channel leg member.
FIG. 10 is a perspective view as in FIG. 9, except that the guide nut is shown inserted into the end of the channel leg member.
Figures 11, 12, 13, 14, 15:
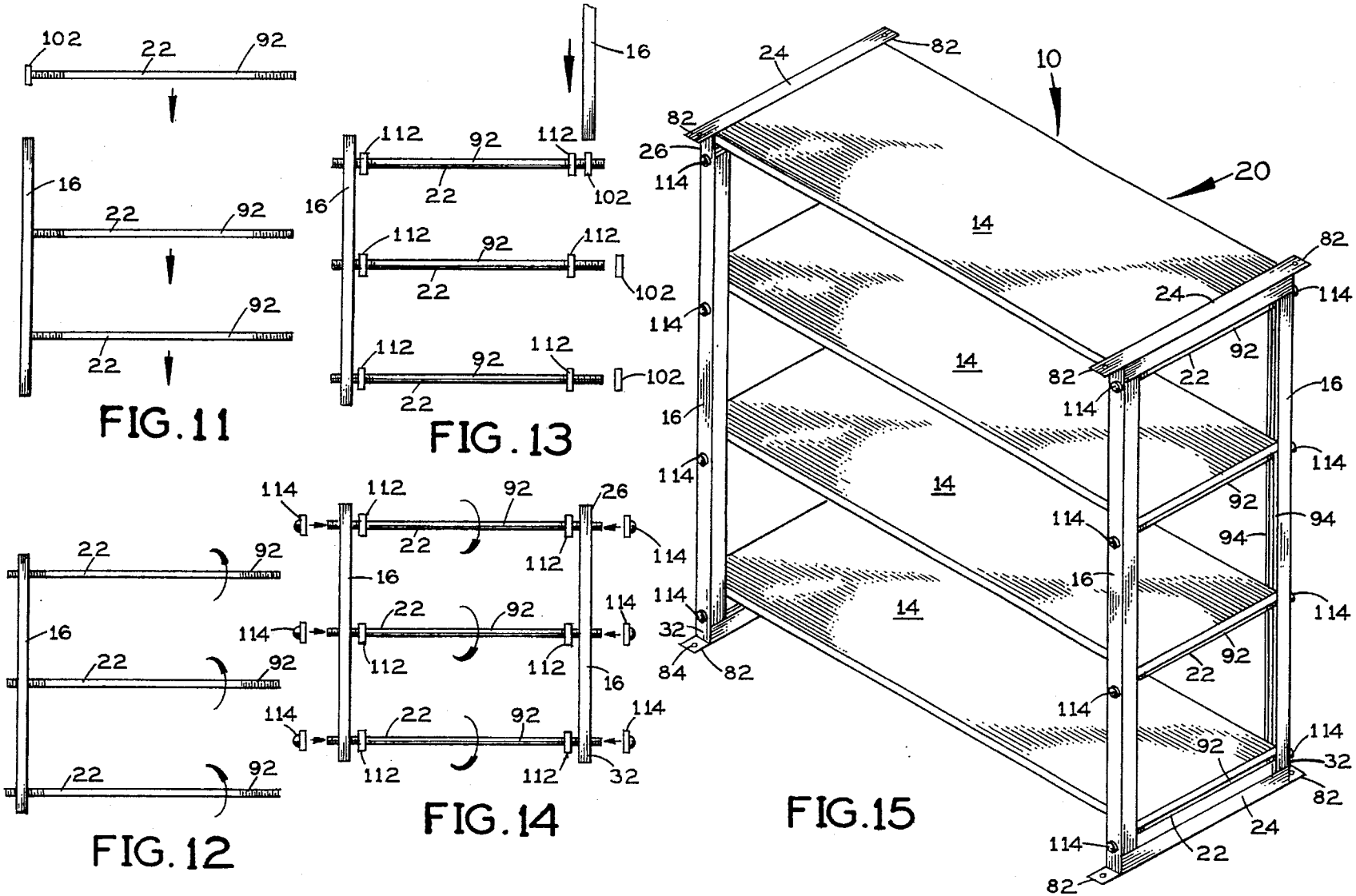
FIG. 11 is a side view of three threaded rod cross-braces as in FIG. 8, except that the guide nuts have been fitted onto first cross-brace ends and the nuts and cross-braces are being moved to advance the guide nuts into the end of a channel leg member.
FIG. 12 is a view as in FIG. 11, with the guide nuts all inserted into the channel leg member end, and the cross-braces aligned with and rotating through the ports in the leg member.
FIG. 13 is a view similar to that of FIG. 11, showing a second channel leg member being advanced over guide nuts at the second ends of the cross-braces. Inner nuts are also shown on the cross-braces for subsequent advancement against the leg members.
FIG. 14 is a view similar to that of FIG. 12, showing the second channel leg member in place over the guide nuts on the second ends of the cross-braces, and outer nuts being advanced toward the first and second cross-brace ends for fastening over these ends and against the channel leg members.
FIG. 15 is a perspective view of the fully assembled third preferred embodiment of the apparatus.

Referring generally to FIGS. 1–15, three preferred embodiments of a shelving apparatus 10 are disclosed, each of which is assembled from a kit 12 of apparatus 10 parts. Apparatus 10 preferably includes several rectangular planar shelves 14 and an even number of elongate channel leg members 16, each leg member 16 having a substantially square U-shaped cross-section and hollow interior. Channel leg members 16 are divided into sets or pairs 20 of two members 16 each. Shelving support elements 22 are provided for each of the several shelves 14 to be installed and are fit into and secured within channel leg members 16, and extend between the two members 16 in each pair 20. The number of shelves 14 accommodated can vary from one to as many as space and strength of the kit 12 materials permit. Pairs 20 of leg members 16 are set vertically upright in a parallel, face to face, and spaced apart straight line series. Shelves 14 are placed on top of a shelving support element 22 of each pair 20, the shelf 14 width extending between the channel leg members 16 of each pair 20, so that the shelf 14 extends longitudinally through the series of leg member pairs 20. A pair 20 is provided at each end of the shelves 14 of assembled apparatus 10, and one or more pairs 20 may be provided between the shelf 14 ends for added strength and support. Channel leg members 16 may be bolted to a wall for added stability, or end caps 24 may be secured to the tops 26 and bottoms 32 of leg member pairs 20 and bolted to a ceiling, wall or floor, or to all of these. Apparatus 10 preferably extends along a wall from one corner to the opposing corner of a room.

First Preferred Embodiment

The first embodiment of apparatus 10 includes simple channel leg members 16, each having a square channel cross section including two substantially parallel, opposing side channel walls 42 and 44 connected at corresponding side wall ends 46 by a connecting channel wall 52. See FIGS. 1–4. Thus in cross-section there are three walled sides 42, 44, 52 and an open channel side 54. Shelving support elements 22 include a series of cross-braces 56, each in the form of a rectangular planar member such as a short plank of wood, for supporting shelves 14. Each cross-brace 56 has two opposing narrow ends **56*a*, and one narrow end 56*a* is snugly fit into the open channel side 54 of each leg member 16 of a leg member pair 20. A cross-brace 56 is thus inserted into the channel leg members 16 of each pair 20 for each shelf 14 to be supported, and are spaced apart from each other within each pair 20. Several cross-brace support pegs 62 are also provided with kit 12, each having a square cross-section sized to snugly fit between side walls 42 and 44 of channel leg members 16. A support peg 62 is fitted into channel leg members 16 between cross-braces 56 to hold cross-braces 56 in their spaced apart relationships under the loading of shelves 12 resting on cross-braces 56. See FIGS. 1 and 2. Then end caps 24 are placed on the tops 26 and bottoms 32 of the endmost cross-braces 56 for securing apparatus 10 to the floor, the ceiling, or a wall. End caps 24 are preferably also square channel members, each having two opposing side cap walls 72 and 74 and a connecting wall 76, substantially as described above for leg members 16. Side cap walls 72 and 74 are preferably cut away from at least one end cap 24 longitudinal end, and optionally from both end cap 24 ends, so that connecting cap wall 76 extends beyond side cap walls 72 and 74 at each end, forming end tabs 82. An anchoring port 84 is preferably drilled in each end tab 82 through which an anchoring bolt 86 may be inserted into the floor, ceiling or a wall. Tabs 82 may be bent at any of various angles relative to the remainder of the end cap 24, as the specific apparatus 10 installation requires. Pairs 20 of leg members 16 are uprighted and shelves 14 are placed across cross-braces 56 of the series of leg member pairs 20**, as described above generally.

The snug friction fit of the support pegs 62 and cross-braces 56 within channel leg members 16 has been found sufficient in prototype testing to in itself to support the assembled apparatus 10. Should exceptionally heavy shelf 14 loading be anticipated, however, securing screws or other fastening means (not shown) may be provided to further anchor the various leg member pair 20 parts together.

Channel leg members 16 and end caps 24 are preferably formed of aluminum of a gauge suitable for the intended shelf 14 loading. Shelves 14, cross-braces 56 and pegs 62 are preferably formed of a suitable, sturdy wood. While these materials are preferred, they should not be construed as limiting because many others are equivalently suitable and contemplated.

Second Preferred Embodiment

The second embodiment of apparatus 10 is essentially like the first except that the cross-braces 58 are wider than in the first, extending in width a distance equivalent to the width of a cross-brace 56 of the first embodiment plus the length of a support peg 62. See FIGS. 5–7. Segments of shelves 14 fit closely between adjacent cross-braces 58, and these shelf 14 segments also carry the loading transmitted through cross-braces 58. Pegs 62 are therefore unnecessary for and eliminated from this embodiment. The wider cross-braces 58 of the second embodiment fit snugly into channel leg members 16 as above, and this friction grip is typically sufficient to support the assembled apparatus 10 with shelves 14 loaded. And, once again, end caps 24 are optionally provided for anchoring apparatus 10 to an adjacent structure.

Third Preferred Embodiment

The third embodiment replaces the planar cross-braces 56 and 58 of the first two embodiments with threaded rod cross-braces 92. See FIGS. 8–15. Channel leg members 16 additionally include longitudinal flanges 94 extending from channel side wall free ends 96 across the open channel side 54 toward each other, to constitute what are known as bolt sliders. A square guide nut 102 is provided for each end of each threaded rod cross-brace 92. Nuts 102 each have a certain square outer side dimension and a certain width both being just slightly smaller than the constant inner cross-sectional length and width of each channel leg member 16, to fit closely inside channel leg members 16. Channel leg members 16 each have cross-brace exit ports 104 drilled in a spaced-apart series along connecting channel wall 52. In addition to guide nuts 102, an inner locking nut 112 and an outer locking nut 114 are preferably provided for each end of each cross-brace 92, for tightening against leg members 16. Inner nut 112 may have any convenient circumferential shape. Outer locking nut 114 is preferably a cap nut having a pleasing appearance, but may alternatively be a wing nut or equivalent. Shelves 14 and optional end caps 24 are provided as mentioned above for the previous embodiments.

Method of Assembling the Third Embodiment

In practicing the invention, the following method may be used. The third embodiment of apparatus 10 requires a particular and inventive method of assembly. The method steps are as follows.

A guide nut 102 is fitted onto a first end of each threaded rod cross-brace 92, so that the cross-brace 92 does not substantially extend from the side of the guide nut 102 opposite where the cross-brace 92 is inserted. The preferred relationship between the nut 102 and the cross-brace 92 is for the inserted end of the cross-brace 92 to be substantially flush with the cross-brace 92 exit face of the guide nut 102. Cross-braces 92 are then in turn each positioned relative to a leg member 16 so that a circumferential face 116 of the guide nut 102 is aligned with the open end of a first leg member 16. See FIG. 9. Then the guide nut 102 is laterally inserted into the open end of the first channel leg member 16 until the cross-brace 92 is aligned with one of the cross-brace ports 104. See FIGS. 10 and 11. This is done for each cross-brace 92 for a given leg pair 20. Cross-braces 92 are rotated to advance the adjacent cross-brace 92 ends through the given cross-brace port 104 a certain distance. See FIG. 12.

Guide nuts 102 are then screwed onto the second ends of cross-braces 92 in the manner described above for the first ends, and the second leg member 16 is fitted over and around the exposed guide nuts 102 until the cross-braces 92 are aligned with the ports 104 in the second cross brace 92. See FIG. 13. Then the threaded rod cross-braces 92 are rotated in a second rotational direction to advance them through ports 104 in the second leg member 16, so that a segment of the cross-braces 92 continue to extend through ports 104 in the first leg member 16. See FIG. 14.

Then each inner nut 112 is advanced to snugly abut the adjacent leg member 16 and each outer nut 114 is screwed onto each protruding end of each cross-brace 92. Then end caps 24 are optionally applied and the leg pair 20 assemblies placed upright and in a spaced apart linear series, and shelves 14 are placed over corresponding cross-braces 92 in each pair 20, longitudinally along the series of pairs 20. See FIG. 15.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A shelving apparatus, comprising:

at least one shelf, a plurality of elongate channel leg members, each said channel leg member having a substantially U-shaped cross-section, two of each said leg members forming a leg member pair, a plurality of shelving support elements for each said at least one shelf, each said shelving support element having channel leg member entry portions for mounting within one of said channel leg members, and having shelf support portions extending between the two said channel leg members in each said leg member pair, wherein there is at least two leg member pairs, said pairs are positioned substantially vertically upright in a spaced apart straight line series, wherein said shelf members are placed on top of said shelf support portions such that said shelf members extend longitudinally through said series of leg member pairs, wherein said channel leg members each have a substantially square channel cross section with two substantially parallel, opposing side channel walls connected at corresponding side wall ends by a connecting channel wall, and an open channel side, and wherein said shelving support elements comprise a series of cross-braces, each in the form of a substantially rectangular planar member having two ends and two longitudinal sides, each of said ends being sized for snugly fitting into said open channel side of each said channel leg member of a leg member pair, wherein said shelf support portions each include one said longitudinal side, said cross-braces being separated from each other by a certain distance, and additionally comprising a plurality of elongate support pegs each having a length equivalent to said certain distance, sized in cross-section for snug insertion into said leg member open channel sides between said cross-braces, to support said cross-braces and shelves.

2. An apparatus according to claim 1, additionally comprising end cap anchor members for securing to top and bottom ends of said channel leg member pairs for bolting to an adjacent structure for added apparatus stability.

3. An apparatus according to claim 1, wherein each said leg member pair has top and bottom pair ends, additionally comprising an end cap anchor member for securing to one said pair end, said end anchor cap having at least one anchor fastener port for receiving a fastener to secure the apparatus to a separate structure for added stability.

4. An apparatus according to claim 3, wherein said end cap anchor member comprises a square channel member having two opposing side cap walls and a connecting cap wall.

5. An apparatus according to claim 4, wherein said connecting cap wall extends longitudinally beyond said side cap walls to form a tab portion, said tab portion having a fastener port for receiving a fastener for securing said apparatus to a separate structure.

6. An apparatus according to claim 5, wherein said tab is bent out of the plane of said connecting cap wall to make greater contact with said separate structure.

7. An apparatus according to claim 1, wherein said channel leg members each have a substantially square channel cross-section with two substantially parallel, opposing side channel walls connected at corresponding side channel wall ends by a connecting channel wall, and an open channel side, and wherein said shelving support elements comprise a series of cross-braces, each in the form of a substantially rectangular planar member having two end sides and two longitudinal sides, each of said end sides being sized for snugly fitting into the open channel side of each said channel leg member of a leg member pair, wherein said shelf support portions each include one said longitudinal side, said cross-braces being separated from each other by a certain distance corresponding to the thickness of said shelf, such that said shelf extends snugly between and carries loading transmitted by said cross-braces.

8. An apparatus according to claim 1, wherein said channel leg members each have a substantially square channel cross-section with two substantially parallel, opposing side channel walls connected at corresponding side channel wall ends by a connecting channel wall, and a fourth side including a longitudinal flange extending from each side channel wall toward the opposing side channel wall, said flanges being sized in width relative to the width of said connecting channel wall to be spaced apart from each other, each said connecting channel wall having a channel port, and wherein said shelving support elements comprise a series of cross-braces, each in the form of an elongate threaded rod having a guide nut at each rod end for lateral insertion into an end of one of said channel leg members and fitting sufficiently closely between said side channel walls that said nut cannot rotate substantially relative to said leg member, said connecting channel wall including a rod port for receiving said rod through rotation of said rod within said nut such that said rod advances into said port.

9. An apparatus according to claim 8, wherein each said cross-brace additionally comprises an inner locking nut for each end of each said threaded rod for advancing into snug contact against one of said leg members.

10. An apparatus according to claim 8, wherein each said cross-brace additionally comprises an outer locking nut for each end of each said threaded rod for advancing into snug contact against one of said leg members.

11. A method of assembling a shelving apparatus comprising at least one shelf, a plurality of elongate channel leg members, each said channel leg member having a substantially U-shaped cross-section, two of each said leg members forming a leg member pair, a plurality of shelving support elements for each said at least one shelf, each said shelving support element having channel leg member entry portions for mounting within one of said channel leg members, and having shelf support portions extending between the two said channel leg members in each said leg member pair, wherein there is at least two leg member pairs, said pairs are positioned substantially vertically upright in a spaced apart straight line series, wherein said shelf members are placed on top of said shelf support portions such that said shelf members extend longitudinally through said series of leg member pairs, wherein said channel leg members each have a substantially square channel cross-section with two substantially parallel, opposing side channel walls connected at corresponding side channel wall ends by a connecting channel wall, and a fourth side including a longitudinal flange extending from each side channel wall toward the opposing side channel wall, said flanges being sized in width relative to the width of said connecting channel wall to be spaced apart from each other, each said connecting channel wall having a channel port, and wherein said shelving support elements comprise a series of cross-braces, each in the form of an elongate threaded rod having a guide nut at each rod end for lateral insertion into an end of one of said channel leg members and fitting sufficiently closely between said side channel walls that said nut cannot rotate substantially relative to said leg member, said connecting channel wall including a rod port for receiving said rod through rotation of said rod within said nut such that said rod advances into said port, comprising the steps of:

fitting said guide nuts onto a first end of each said threaded rod cross-brace, such that said cross-brace does not extend substantially from the side of the guide nuts opposite the side of said guide nuts where said cross-brace is inserted, positioning said cross-braces such that a circumferential face of each said guide nut is aligned with said open end of each said leg member, laterally inserted said guide nuts into said channel leg members until said cross-braces are each aligned with one of said cross-brace ports, rotating each said cross-brace to advance said adjacent cross-brace end through the given said cross-brace port a certain distance, screwing said guide nuts onto said second ends of said cross-braces, such that said cross-braces do not extend substantially from the side of the guide nuts opposite the side of said guide nuts where said cross-braces are inserted, fitting said second leg member over and around said guide nuts on said second ends until said cross-braces are aligned with said ports, rotating said threaded rod cross-braces in a second rotational direction to advance said cross-braces through said ports in said second leg member, such that a segment of said cross-braces continues to extend through said ports in said first leg member, positioning said leg pairs upright and in a spaced apart linear series, placing said shelves over corresponding cross-braces in each said pair, longitudinally along said series.

* * * * *